US005348291A

United States Patent [19]

Scully

[11] Patent Number: 5,348,291

[45] Date of Patent: Sep. 20, 1994

[54] BALL PITCHING TRAINER

[76] Inventor: Michael T. Scully, 315 Reflection Cir. Apt. 11, San Ramon, Calif. 94583

[21] Appl. No.: 938,884

[22] Filed: Aug. 31, 1992

Related U.S. Application Data

[63] Continuation of Ser. No. 665,009, Mar. 5, 1991, abandoned.

[51] Int. Cl.[5] ..... A63B 69/40

[52] U.S. Cl. ..... 273/26 A

[58] Field of Search ..... 273/29 A, 181 J, 181 R, 273/181 G, 411, 30, 26 A

[56] References Cited

U.S. PATENT DOCUMENTS

| | | |
|---|---|---|
| 795,317 | 7/1905 | Tanty . |
| 1,322,754 | 11/1919 | Blair . |
| 1,327,072 | 1/1920 | Thorward . |
| 3,195,898 | 2/1962 | Respini . |
| 3,968,968 | 7/1976 | Peterson . |
| 3,993,306 | 11/1976 | Scott . |
| 4,093,224 | 6/1978 | Hale . |
| 4,109,910 | 8/1978 | Gleason . |
| 4,135,716 | 1/1979 | Ginsburg . |
| 4,473,227 | 9/1984 | Klaus . |
| 4,979,754 | 12/1990 | Eisenhart . |

*Primary Examiner*—Theatrice Brown

*Attorney, Agent, or Firm*—Woodard, Emhardt, Naughton, Moriarty & McNett

[57] ABSTRACT

A ball pitching trainer is disclosed having two supports. Each support has a base at an upright and may be disassembled for transport and storage. A target area is suspended between the uprights. The target is defined by an upper horizontal cord and a lower horizontal cord. Two vertical cords are suspended from the upper horizontal cord further defining the open target area. Springs, elastomeric or otherwise, absorb shock from an errant ball striking the target. Fittings are provided for ready adjustment of the target area vertically and horizontally. The bases have hollow interiors for the addition and removal of ballast. Weights are used to keep the vertical cords plumb.

3 Claims, 3 Drawing Sheets

BALL PITCHING TRAINER

This application is a continuation of application Ser. No. 07/665,009, filed Mar. 5, 1991 abandoned.

BACKGROUND OF THE INVENTION

The present invention relates generally to a training device for baseball and similar games, and more specifically provides a device for training accurate and consistent pitching.

In baseball, the target or strike zone for pitching comprises an imaginary rectangular area oriented in a vertical plane and extending the width of home plate and vertical distance between the batter's knees and the letters on the uniform at the batter's chest. It is advantageous for practice and training purposes to have a device which provides a target for a pitcher. A variety of systems have been developed, although they have certain limitations. One general type of device is disclosed in U.S. Pat. No. 4,826,164 to Butcher and in U.S. Pat. No. 4,643,423 to Wright in which the target comprises a net or a fabric material which catches the pitched ball. Another such device is the "pitch-back" type device which essentially comprises a square steel frame supporting a central net. The net is supported by springs to provide it with a trampolene-type action and typically the net has a target in the center thereof. With this "pitch-back" type device, when the ball strikes the net, the trampoline action reverses the direction of the ball, tossing it back to the pitcher for easy retrieval. These devices suffer the inherent limitation that not all pitchers pitches are perfect, and great frustration can ensue when an errant ball completely misses the net, causing the ball to roll down the field.

Another type of device is disclosed in U.S. Pat. No. 3,312,467 to Dawson. This device discloses a unitary rectangular frame, like the pitch-back type frame discussed above. The frame supports four cords defining a target area in which the ball passes through, typically to a catcher on the opposite side. This device has several limitations, including limited adjustability, and a cumbersome frame structure which, if struck by a pitched ball, would deflect the ball and quite probably be toppled. An errant ball striking the target can be deflected, ricochet up into the face of a catcher and causing injury. Other devices have been used with steel poles embedded in the ground with a variety of string structures tied tightly therebetween.

The present invention provides a unique combination of features which provides a significant advantage over these older systems. The present invention is readily portable and may be conveniently set up over home plate, out in a grassy field, in a gymnasium, or elsewhere. The device provides a target which is readily visible from the pitcher's mound while minimizing the cross-sectional area presented by the target. Thus, the frequency of an errant ball striking the target is minimized, providing advantages in convenience and safety. With older devices an errant ball may knock the target device over causing frustration and possible injury.

Additionally, the present invention provides a target structure which includes flexible cord and shock absorbing elastomeric members and/or springs. When an errant ball strikes the target structure it only minimally disrupts the trajectory of the ball and avoids toppling of the device.

The present invention also provides free standing base structures which can receive ballast for added stability.

Furthermore, the present invention provides a fully adjustable target configuration which may be moved vertically and horizontally, as well as being changed in shape and size. The coach may assist his pitchers in working on a particular type of pitch, such as a low pitch, an inside pitch, an outside pitch, a high pitch, and so forth. The target can also be adjusted for different size players from little-league up to the major leagues.

The target structure includes vertical cords which suspend weights, maintaining target integrity while optimizing target flexibility if hit by an errant ball.

The present invention has been used and endorsed by Mr. Stan Williams, former major league pitcher and present pitching coach for the World Series Champion Cincinnati Reds.

SUMMARY OF THE INVENTION

According to one embodiment, the present invention provides a portable baseball training device for ball pitching practice comprising a first support and a second support. The supports each comprise a base holding up an upright, and the bases are separate from each other and provide free-standing support of the respective upright above a generally horizontal floor surface, such as grass, ground, gymnasium floor or the like. Target means are suspended between the upright members for providing the target for pitching the ball, wherein the target means define an open pitching target to allow the ball to pass through the target. The target means is selectively adjustable to allow selective vertical and horizontal positioning of the open pitching target. Suspension means are provided for suspending the target means between the upright members. The suspension means include spring means for dampening shock caused by an errant ball striking the target means peripherally around the open pitching target. In the preferred embodiment, the adjustable target means includes a horizontal cord and two vertical cords hung from the horizontal cord by fittings which are adjustable laterally.

According to another embodiment, the present invention provides a portable baseball training device for ball pitching practice, comprising first and second supports each comprising a stabilizing base holding up an upright. Target means are suspended between the upright members for providing a target for pitching the ball, wherein the target means defines an open pitching target to allow the ball to pass through the target. The stabilizing bases are separate from each other and provide free-standing support of their respective upright and each define a separate hollow interior therein for holding ballast. Each stabilizing base has a closure and opening to allow addition and removal of ballast, such as sand, water or the like.

According to another embodiment, the present invention provides a portable baseball training device for ball pitching practice, comprising support means and a target means. The target means includes an upper generally horizontal cord, a left generally vertical cord hung from the horizontal cord and a right generally vertical cord hung from the horizontal cord. The vertical cords are each attached to the horizontal cord by a fitting which is selectively slidable horizontally along the horizontal cord to allow selective horizontal positioning of the open pitching target.

One object of the present invention is to provide an improved ball pitching trainer.

Another object of the present invention is to provide improved safety, reducing ricochet and deflection of a pitched ball which errantly strikes the target device.

Another object of the present invention is to provide a ball pitching trainer which is readily portable and light weight for shipping and transport, and yet may be filled with ballast to provide stability in use.

Another object of the present invention is to provide a readily adjustable target area in a ball pitching trainer.

These and other objects are set forth in the disclosure of the present invention.

BRIEF DESCRIPTION OF THE DRAWINGS

FIG. 2 further illustrates in phantom line an adjusted position of the target.

DESCRIPTION OF THE PREFERRED EMBODIMENT

Figure 1:
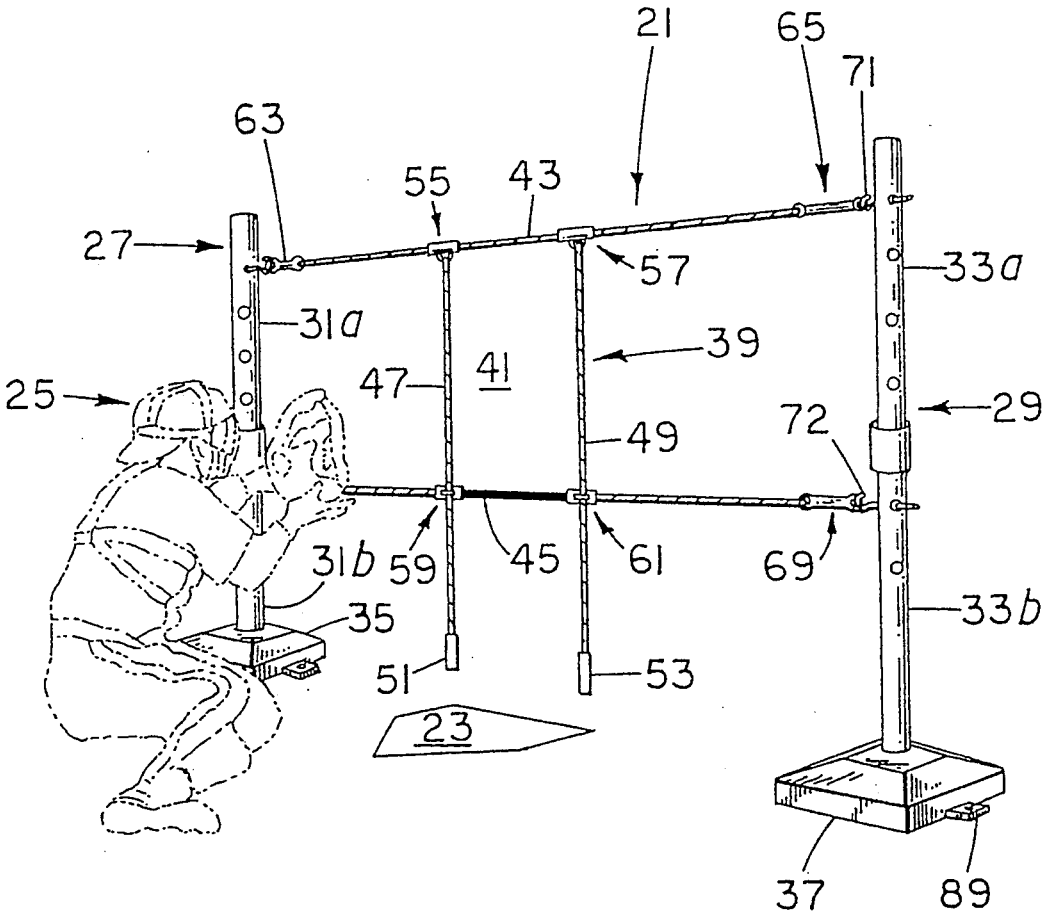
FIG. 1 is a rear perspective view of one embodiment of the present invention set up over home plate.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to the drawing figures, the preferred embodiment of ball pitching trainer 21 is illustrated. It is to be understood that for simplicity the present invention is described in the terms of "baseball", it being understood that herein the term baseball includes baseball, softball, wiffle ball, cricket and other such games in which a pitcher pitches a ball to a batter. FIG. 1 shows training device 21 located over home plate 23 with catcher 25 shown in phantom lines behind device 21. The present invention may likewise be used over grass, on a gymnasium floor or the like, each such environment constituting a "floor surface" within the meaning of the present invention.

Device 21 includes support 27 and support 29, typically about four and a half feet tall and spaced about six feet apart. In the preferred embodiment, support 27 is made up of three major constituent parts: base 35 which holds a first upright made of upright 31*a* and upright 31*b*. Uprights 31*a* and 31*b* may be a single piece optionally, but in the preferred embodiment are made of at least two pieces telescopically nested together as shown to allow compact breakdown. The uprights may be preferably removable from the base for storage and transport purposes. Likewise, support 29 includes upright 33*a* and upright 33*b* held up by base 37. These two uprights are independent from each other and are made with the respective bases to be free-standing and independent.

Target 39 is suspended between uprights 27 and 29. Target 39 is the structure defining open pitching target 41. As illustrated in FIG. 1, open target area 41 is sized and positioned to represent the strike zone above home plate 23. Target area 41 is an open area which allows the ball to pass through target 39 and target area 41 to be caught by the catcher 25. Target 39 is partially defined by and is suspended by upper cord 43 which in the preferred embodiment is generally horizontal and is suspended between support 27 and support 29. Preferably, cord 43 is attached or suspended from the supports by a spring mechanism such as one or more elastomeric bands, such as elastomeric band 63 and elastomeric band 65. Optionally, these springs may be metal or other mechanical springs or pulley and weight mechanisms. Furthermore, these may be replaced by having some or all of cord 43 comprised an elastic cord, such as a bunge cord or the like. An important feature is having this highly elastic component to allow cord 43, which is flexible, to readily deflect out of the path of an errant ball. In this way, safety is enhanced since the likelihood an errant pitch striking the target and being suddenly deflected into the catcher is greatly reduced. Additionally, it is important to note that unlike prior devices, preferably the present invention provides its entire suspension mechanism with a flexible, brightly colored cord, preferably a single cord, as illustrated with the small frontal profile. This greatly reduces the likelihood or incidence of an errant ball striking the suspension mechanism. No cross brace, such as a steel bar, is provided between support 27 and support 29.

Target area 41 is partially defined by lower horizontal cord 45, right cord 47 and left cord 49. Preferably, each of these cords, like cord 43, is brightly colored to enhance visibility. Such coloring may be bright orange, bright yellow or other visible color. Such cord typically is relatively narrow, such as number 30 nylon cord. The bright color enhances the visibility of the target to compensate for the small profile. Optionally the bottom cord 45 (or the top cord 43) may have an index or marking thereon corresponding to the standard width of target area 41. This is illustrated as the darker central portion of cord 45 which is 17 inches wide corresponding to the width of home plate and the standard strike zone. Thus, this width can be established even if device 21 is set up away from an actual home plate.

Figure 3:
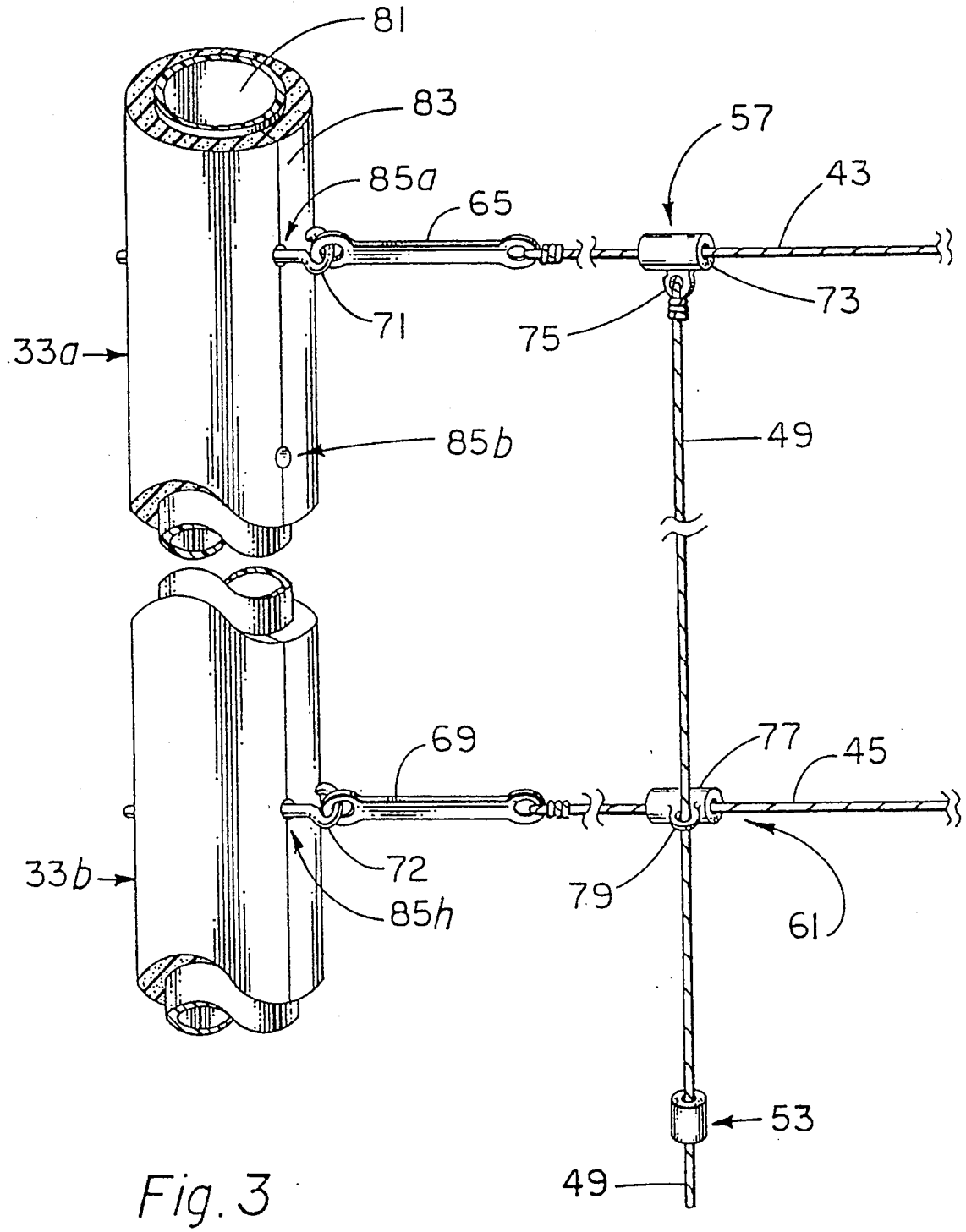
FIG. 3 is a front perspective fragmented detail of a portion of the device of FIG. 1.

Vertical cords 47 and 49 are suspended from horizontal cord 43 by fittings 55 and 57. Right cord 47 preferably has weight 51 attached to it. Likewise, cord 49 has weight 53. These weights assist in maintaining the vertical cords generally plumb. The fittings, such as fitting 57, are best illustrated in FIG. 3. Such fitting may comprise a variety of structures. In the preferred embodiment, fitting 57 has two primary elements, slide 73 and eyelet 75. Slide 73 in the preferred embodiment is a body of elastomeric material, such as rubber, having a lateral hole therethrough. Cord 43 is located in the lateral hole which provides a snug, friction fit on the horizontal cord. In this way, a simple fitting is provided which resists lateral movement of fitting 57 during ordinary use while allowing ready adjustment of the target by holding the cord and sliding the fitting along the horizontal cord. Eyelet 75 provides a convenient attachment point for vertical cord 49.

Horizontal cord 45 provides the lower most boundary of target area 41. Fitting 61 is essentially the same as fitting 57, having slide 77 and eyelet 79. Vertical cord 49 is threaded through eyelet 79 of lower fitting 61 and allowed to move vertically up and down with respect to fitting 61. In this way, if an errant ball strikes vertical cord 49, slack is provided to allow the cord to readily move out of the way of the ball. The weights, such as weight 53, may be a variety of structures, their primary purpose being to keep the vertical cords taut. In the preferred embodiment, weight 53 comprises an elastomeric material, such as rubber, with a vertical opening therethrough to receive the vertical cord in a snug, friction fit. In this way, the cord may be adjusted vertically. In the preferred mode of use, weight 53 is adjusted upwardly a few inches below the lower fitting 61. Thus, slack is available, as described above, but if weight 53 is struck by an errant ball, there is not so much slack that it will be readily spun around horizontal cord 45, entangling the structure.

Preferably, a shock absorbing function of suspending the target is provided by elastomeric bands 63, 65, 67 and 69. In the illustrated embodiment, these comprise a rubber shock absorber several inches long in a band-like configuration with an eyelet at each end. One eyelet provides ready securement to its respective horizontal cord. The other eyelet provides ready attachment to the vertical supports. Attachment to the supports may be provided in a multitude of ways. In the preferred embodiment connectors, such as connectors 71 and 72 are provided which are eye bolts located in openings in the upright. Typically six to eight openings, such as opening 85*a*, 85*b* and 85*h* (see FIG. 3) are provided in a vertical array every five inches on each support. Optionally, permanent attachments may be provided on the uprights as well as the structure providing an infinite number of vertical attachment points, the key function of this feature being that the position of horizontal cords 43 and 45 are vertically adjustable to allow selective adjustment of the position, size and shape of target area 41.

Figure 2:
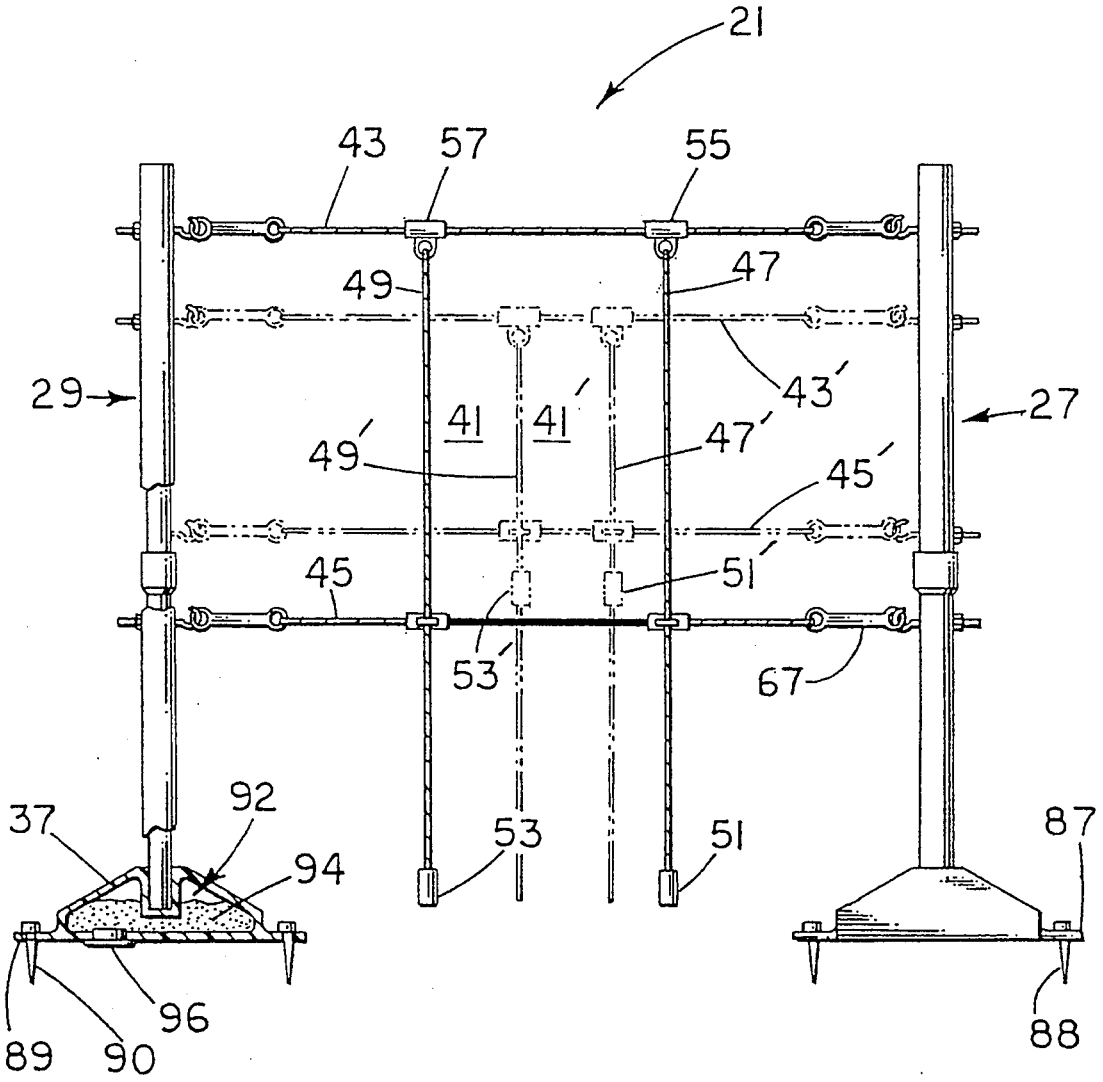
FIG. 2 is a front elevation view of the device of FIG. 1, partially cut away to illustrate the construction of a typical support.

This selective adjustability of the target is best illustrated in FIG. 2 shown in phantom lines and primed numbers. Specifically, target area 41 representing the strike zone may be reduced and relocated to strike zone 41' to work on particular pitches in the zone illustrated. Horizontal cord 43 is relocated downwardly as 43'. Horizontal cord 45 is adjusted upwardly to 45'. Vertical cord 49 is adjusted inwardly to 49'. Vertical cord 47 is adjusted inwardly to 47'. Weight 53 is slid upwardly to 53'. Weight 51 is slid upwardly to 51'. FIG. 2 also illustrates a typical construction of support, such as support 29, shown partially cut away. Specifically, base 35 is shown cut away with its hollow interior 92 containing ballast 94. Ballast may comprise sand, water or other heavy material. Closure 96 is provided in an opening in base 37 to allow the addition and/or removal of ballast 94. The structure of the closure and opening may vary, with a threaded plug structure being quite suitable. The bases may be made lightweight without ballast for shipping, transport and storage purposes, but may be made heavier with added ballast to provide additional stability. Additionally, the bases may include a variety of flanges, such as flange 87 and flange 89, or other mechanisms for providing a hole to receive stakes 88 and stake 90, respectively. This optional feature provides yet further stability when the device is used on ground. The bases may be made of molded plastic and preferably have a recess in the top side thereof for receiving the respective upright member. The bases illustrated have a 14"×14" footprint. As illustrated in FIG. 2, this recess receives an interior sleeve of PVC pipe comprising the structural component of the upright. Preferably, this PVC pipe is wrapped on its exterior by a layer of foam for improved safety padding and cosmetic enhancement. FIG. 3 illustrates tube 81, typically PVC pipe, with rubber casing 83 wrapped around the outside and glued thereto.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A portable baseball training device for ball pitching practice, comprising:

a first support comprising a first stabilizing base holding up a first upright member;

a second support comprising a second stabilizing base holding up a second upright member, wherein said first stabilizing base and said second stabilizing base are separate from each other and each provide free-standing support of their respective upright above a generally horizontal floor surface;

target means suspended between said first upright member and said second upright member for providing a target for a pitched ball, wherein said target means defines an open pitching target to allow the ball to pass through the target to be caught by a catcher, wherein said target means is selectively adjustable to allow selective positioning of the open pitching target with respect to said uprights; and suspension means for suspending said target means between said first and second upright members, wherein said suspension means includes spring means located between said target means and said first and second upright members for dampening shock caused by an errant ball striking said target means peripherally around said open pitching target;

wherein said suspension means consists essentially of:

(a) said spring means; and (b) a first generally horizontal cord suspended between said first and second uprights, partially defining said open target area, wherein said horizontal cord provides a small profile to reduce the incidence of an errant ball striking said cord;

wherein said first support and said second support are free of any rigid cross-brace support therebetween, wherein said first upright member and said second upright member are spaced apart from each other not more than about six feet, and further wherein said target means include a left generally vertical cord hung from said first cord and further includes a right generally vertical cord hung from said first cord to partially define the open pitching target between said left cord and said right cord, wherein said left and right vertical cords are narrow, brightly colored cord;

wherein said left cord is attached to said suspension means by a left fitting, and wherein said right cord is attached to said suspension means by a right fitting, and wherein said left fitting and said right fitting are selectively slidable horizontally along said first horizontal cord to allow selective horizontal positioning of the open pitching target with respect to said uprights;

wherein said right cord and said left cord have a weight secured thereto to pull said right and left cords taut;

wherein said first stabilizing base and said second stabilizing base each define a separate hollow interior therein for holding ballast and each stabilizing base has a closure and opening to allow addition and removal of ballast;

wherein said target means includes a lower generally horizontal cord suspended on between said first and second uprights and below said suspension means;

wherein said lower generally horizontal cord has a lower right fitting attached thereto and securing said right generally vertical cord, and wherein said lower generally horizontal cord has a lower left fitting attached thereto and securing said left generally vertical cord, and wherein said lower left fitting and said lower right fitting are selectively horizontally slidable along said lower cord.

2. A portable baseball training device for ball pitching practice, comprising:

a first support comprising a first stabilizing base holding up a first upright member;

a second support comprising a second stabilizing base holding up a second upright member, wherein said first stabilizing base and said second stabilizing base are separate from each other and each provide free-standing support of their respective upright above a generally horizontal floor surface;

target means suspended between said first upright member and said second upright member for providing a target for a pitched ball, wherein said target means defines an open pitching target to allow the ball to pass through the target to be caught by a catcher, wherein said target means is selectively adjustable to allow selective positioning of the open pitching target with respect to said uprights; and suspension means for suspending said target means between said first and second upright members, wherein said suspension means includes spring means located between said target means and said first and second upright members for dampening shock caused by an errant ball striking said target means peripherally around said open pitching target;

wherein said suspension means consists essentially of:

(a) said spring means; and (b) a first generally horizontal cord suspended between said first and second uprights, partially defining said open target area, wherein said horizontal cord provides a small profile to reduce the incidence of an errant ball striking said cord;

wherein said first support and said second support are free of any rigid cross-brace support therebetween, wherein said first upright member and said second upright member are spaced apart from each other not more than about six feet, and further wherein said target means include a left generally vertical cord hung from said first cord and further includes a right generally vertical cord hung from said first cord to partially define the open pitching target between said left cord and said right cord, wherein said left and right vertical cords are narrow, brightly colored cord;

wherein said left cord is attached to said suspension means by a left fitting, and wherein said right cord is attached to said suspension means by a right fitting, and wherein said left fitting and said right fitting are selectively slidable horizontally along said first horizontal cord to allow selective horizontal positioning of the open pitching target with respect to said uprights;

wherein said right cord and said left cord have a weight secured thereto to pull said right and left cords taut;

wherein said first stabilizing base and said second stabilizing base each define a separate hollow interior therein for holding ballast and each stabilizing base has a closure and opening to allow addition and removal of ballast;

wherein said target means includes a lower generally horizontal cord suspended between said first and second uprights and below said suspension means;

wherein said lower generally horizontal cord has a lower right fitting attached thereto and securing said right generally vertical cord, and wherein said lower generally horizontal cord has a lower left fitting attached thereto and securing said left generally vertical cord, and wherein said lower left fitting and said lower right fitting are selectively horizontally slidable along said lower cord; and, at least four elastomeric members to dampen shock caused by an errant ball striking said target means peripherally around said open pitching target, said four elastomeric members being attached to said first and second uprights in two pairs with said first horizontal cord suspended between an upper pair of elastomeric members and said lower horizontal cord suspended between a lower pair of elastomeric members, and wherein said first and second uprights each have selectable attachment fittings vertically arrayed to receive said elastomeric members at selected heights to allow selective vertical positioning of the open pitching target with respect to said uprights, and wherein said first stabilizing base and said second stabilizing base each have a plurality of ground anchor means for receiving a stake therethrough into ground beneath said bases to provide additional stability.

3. A portable baseball training device for ball pitching practice, comprising:

a first support comprising a first stabilizing base holding up a first upright member;

a second support comprising a second stabilizing base holding up a second upright member, wherein said first stabilizing base and said second stabilizing base are separate from each other and each provide free-standing support of their respective upright above a generally horizontal floor surface;

target means suspended between said first upright member and said second upright member for providing a target for pitching the ball, wherein said target means defines an open pitching target to allow the ball to pass through the target, wherein said target means is selectively adjustable to allow selective positioning of the open pitching target with respect to said uprights; and suspension means for suspending said target means between said first and second upright members, wherein said suspension means includes spring means for dampening shock caused by an errant ball striking said target means peripherally around said open pitching target;

wherein said first support and said second support are free of any rigid cross-brace support therebetween, and further wherein said target means include a left generally vertical cord hung from said suspension means and further includes a right generally vertical cord hung from said suspension means to partially define the open pitching target between said left cord and said right cord;

wherein said left cord is attached to said suspension means by a left fitting, and wherein said right cord is attached to said suspension means by a right fitting, and wherein said left fitting and said right fitting are selectively slidable horizontally along said suspension means to allow selective horizontal positioning of the open pitching target with respect to said uprights;

wherein said right cord and said left cord have a weight secured thereto to pull said right and left cords taut;

wherein said target means includes a lower generally horizontal cord suspended between said first and second uprights and below said suspension means;

(a) wherein said lower generally horizontal cord has a lower right fitting attached thereto and securing said right generally vertical cord, and (b) wherein said lower generally horizontal cord has a lower left fitting attached thereto and securing said left generally vertical cord, and wherein said lower left fitting and said lower right fitting are selectively horizontally slidable along said lower cord.

* * * * *